US010498050B1

(12) United States Patent
Liang et al.

(10) Patent No.: US 10,498,050 B1
(45) Date of Patent: Dec. 3, 2019

(54) WIRE CONNECTOR

(71) Applicant: HEAVY POWER CO., LTD., New Taipei (TW)

(72) Inventors: Cheng-Hua Liang, New Taipei (TW); Chien Ming Tseng, New Taipei (TW)

(73) Assignee: HEAVY POWER CO., LTD., New Taipei (TW)

( * ) Notice: Subject to any disclaimer, the term of this patent is extended or adjusted under 35 U.S.C. 154(b) by 0 days.

(21) Appl. No.: 16/146,266

(22) Filed: Sep. 28, 2018

(51) Int. Cl.

| | |
|---|---|
| ***H01R 4/48*** | (2006.01) |
| ***H01R 9/24*** | (2006.01) |
| ***H01R 4/22*** | (2006.01) |
| ***H01R 13/506*** | (2006.01) |
| ***H01R 11/11*** | (2006.01) |

(52) U.S. Cl.
CPC ..... *H01R 4/4827* (2013.01); *H01R 4/22* (2013.01); *H01R 9/24* (2013.01); *H01R 11/11* (2013.01); *H01R 13/506* (2013.01)

(58) Field of Classification Search
CPC .... H01R 4/4827; H01R 11/11; H01R 13/506; H01R 9/24; H01R 4/22
USPC ..... 439/439, 828, 834
See application file for complete search history.

(56) References Cited

U.S. PATENT DOCUMENTS 3,474,389 A * 10/1969 Nagano Hideo ..... H01R 4/489 24/134 R
5,226,830 A * 7/1993 Ueno ..... H01R 35/025 439/15
7,255,592 B1 * 8/2007 Tseng ..... H01R 4/22 439/439
7,287,999 B2 * 10/2007 Holterhoff ..... H01R 4/4836 439/441
D659,640 S * 5/2012 Tseng ..... D13/133
8,858,269 B2 * 10/2014 Brand ..... H01R 4/4827 439/733.1
9,466,894 B2 * 10/2016 Wu ..... H01R 4/4836
9,553,406 B2 * 1/2017 Wu ..... H01R 4/4836
2003/0066673 A1 * 4/2003 Doutaz ..... H01R 4/4836 174/652
2005/0181681 A1 * 8/2005 Arai ..... H01R 4/4818 439/787
2006/0051993 A1 * 3/2006 Dillon ..... H01R 13/62933 439/157
2012/0208394 A1 * 8/2012 Tseng ..... H01R 4/4818 439/438

(Continued)

*Primary Examiner* — Abdullah A Riyami
*Assistant Examiner* — Nelson R. Burgos-Guntin
(74) *Attorney, Agent, or Firm* — Rabin & Berdo, P.C.

(57) ABSTRACT

The present invention relates to a wire connector for wire being inserted along an inserting direction, comprising: a cover, a conductor and a plurality of shift levers. The cover has a plurality of inserting holes along the inserting direction and a receiving space. The conductor is assembled in the receiving space, and comprising a conductive portion contacts the wire and a plurality of elastic portions that are located in an extended position of inserting holes respectively. The shift levers are pivoted on the cover and swing between a first position which non-contact the elastic portion and a second position which presses the elastic portion. Wherein a first fixed device is formed in the first position for fixing the shift levers, and a second fixed device is formed in the second position for fixing the shift levers. So that the fixed function of the shift levers will be strengthened in the first and second position.

8 Claims, 8 Drawing Sheets

(56) References Cited

U.S. PATENT DOCUMENTS

| | | | | |
|---|---|---|---|---|
| 2013/0143427 | A1* | 6/2013 | Abundis | H01R 4/4836<br>439/310 |
| 2015/0249295 | A1* | 9/2015 | Tseng | H01R 4/4818<br>439/668 |

* cited by examiner

WIRE CONNECTOR

FIELD OF THE INVENTION

The present invention relates to a wire connector, and more particularly to a wire connector for a plurality of wires that are inserted therein to electively connect each other.

BACKGROUND OF THE INVENTION

Wire connector was founded in a slice type connecting terminal (model JTSL-1022) which was invented by Phoenix company, German, in 1928. Since then, a prototype of connector has changed into a connective wire connector with different kind of terminal. For the purpose of connecting or breaking the connection between a plurality of wires with the same or different kind of terminal according to the needs, the wires neither have to be welded or twisted nor using special connector for different kind of terminal additionally. In addition to reducing the cost of processing procedure for connecting the wires, it can increase the freedom of interior design and reduce the working time for assembling wires as well.

The connector can be classified into plug type, fencing type, spring type, track type, H style through-wall type, WMSTB type, and so on. Applying to the industry of lightening, communication and security; mostly used in variable frequency, explosion protection, digital control panel, door security, sensor, PLC program controller, appearance of instrument, power, and servo driver.

SUMMARY OF THE INVENTION

A primary object of the present invention is to provide a wire connector for strengthening the function of fixing shift levers while the wires are inserted or not be inserted into the wire connecter, and preventing the shift lever from moving when the wire connector is crashed by an external force. Further, providing a voice and an operation sense for the user hand to know whether the shift lever is fixed firmly.

Another object of the present invention is to provide the fixed devices in the moving track of the shift lever for simplifying the fixing steps of inserting the end of wire and increasing the convenience of manual operation. Thereby, reducing the connection steps of the wires and the equipment cost corresponding to the connection steps; meanwhile, increase the convenience for connecting, distributing or repairing the wires.

To achieve the above and other objects, the wire connector for a plurality of wires being inserted along an inserting direction, comprising: a cover, a conductor and a plurality of shift levers.

The cover has a plurality of inserting holes along the inserting direction and a receiving space communicates with the plurality of inserting holes.

The conductor is assembled in the receiving space of the cover, and comprises a conductive portion that contacts the wire, and a plurality of elastic portions that are located in an extended position of each inserting hole respectively, so that the wire will be clamped by the conductive portion and elastic portion after inserting the interior of the cover.

The shift levers are pivoted on the cover and swing between a first position which non-contacts the elastic portion and a second position which presses the elastic portion for generating a deformation.

The wire connector further comprising: A first fixed device is formed in the first position for fixing the shift levers; and a second fixed device is formed in the second position for fixing the shift levers.

In the preferred embodiment, the first fixed device comprises a first block being formed with one of the shift levers and the cover, and a first groove being formed with another of the shift levers and the cover for corresponding the position of the first block.

the second fixed device is formed with the group consisting of both of the shift levers and the cover, both of the shift levers and the elastic portions, and triple of the shifts, the cover and the elastic portions.

In one preferred embodiment, the second fixed device comprises a plurality of shift bars are extending from the opposite sides of the shift levers, and a plurality of slots are dividedly formed on the cover for corresponding the position of the shift bars.

The second fixed device also comprises a second block being formed with one of the shift levers and the cover, and a second groove being formed with another of the shift levers and the cover for corresponding the position of the second block.

The second fixed device further comprises a third block being formed with the elastic portion and a pressure portion being formed with the shift lever for corresponding the position of the third block.

From the above description, the wire connector of the present invention is characterized in the first fixed device and second fixed device are formed in the swinging track of the shift levers for fixing the shift levers. Otherwise, the first fixed device and the second fixed device are constructed by both or three of the shift levers, elastic portion and cover. So that the present invention can strength the fixing force of the shift lever in the first position and the second position and provide a sense of user hand to know whether the shift lever is fixed in a right position.

The wire connector can simplify the steps of inserting the wire and increase the convenience for user operation. In addition to decrease the connection process between conductive structures and the equipment cost for corresponding with the connection process.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof and by referring to the accompanying drawings.

Figure 1A:
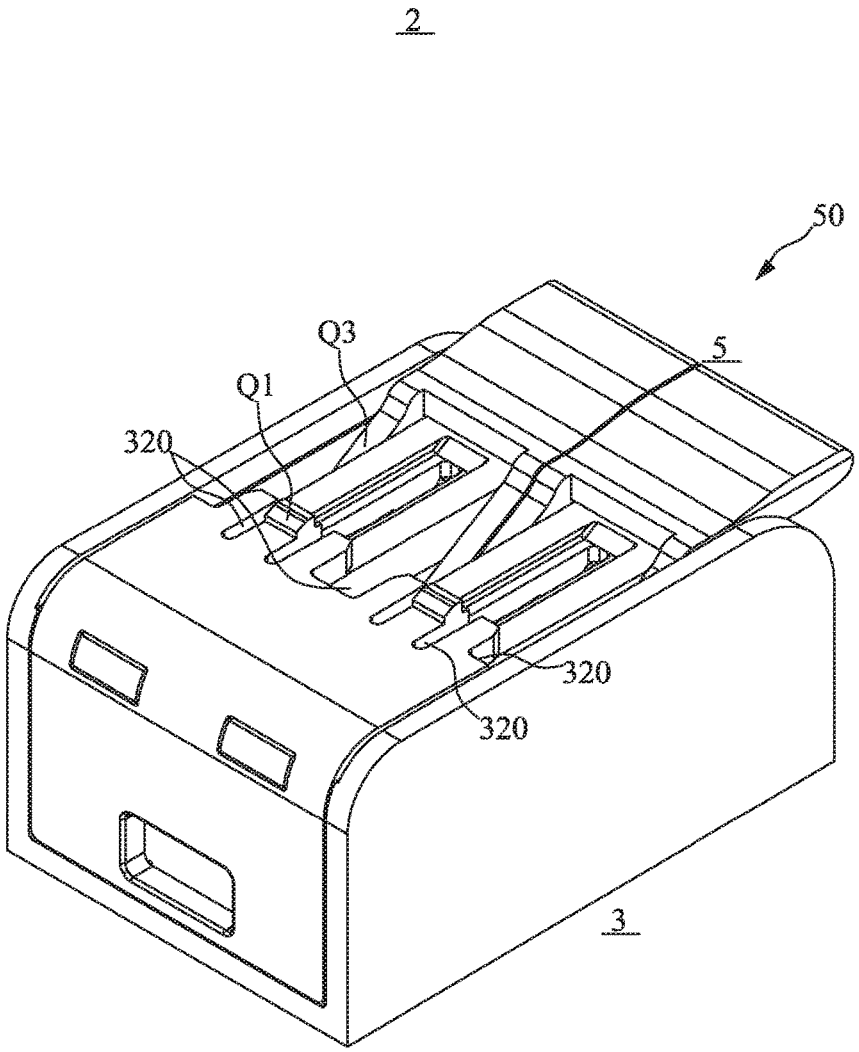
FIG. 1A is a perspective view of a wire connector according to a preferred embodiment of the present invention.
Figure 4:
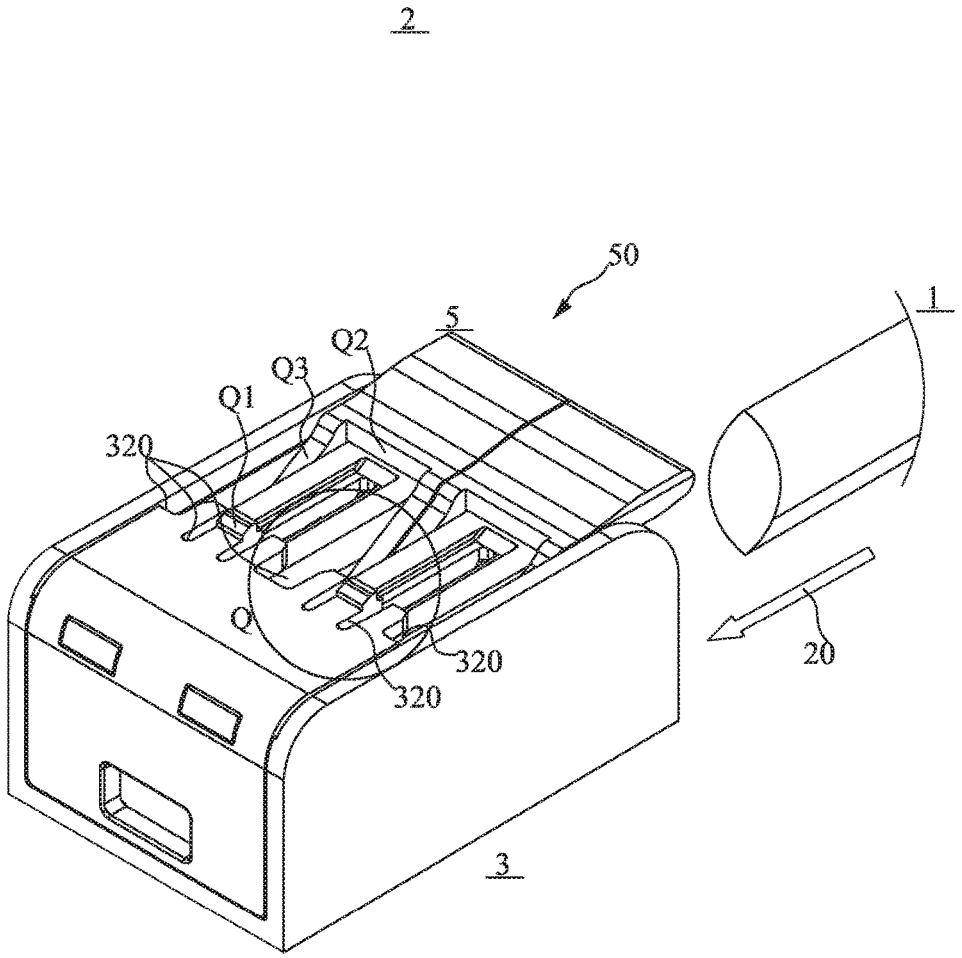
FIG. 4 shows a wire to insert into the wire connector along an inserting direction according to a preferred embodiment of the present invention.
Figure 5:
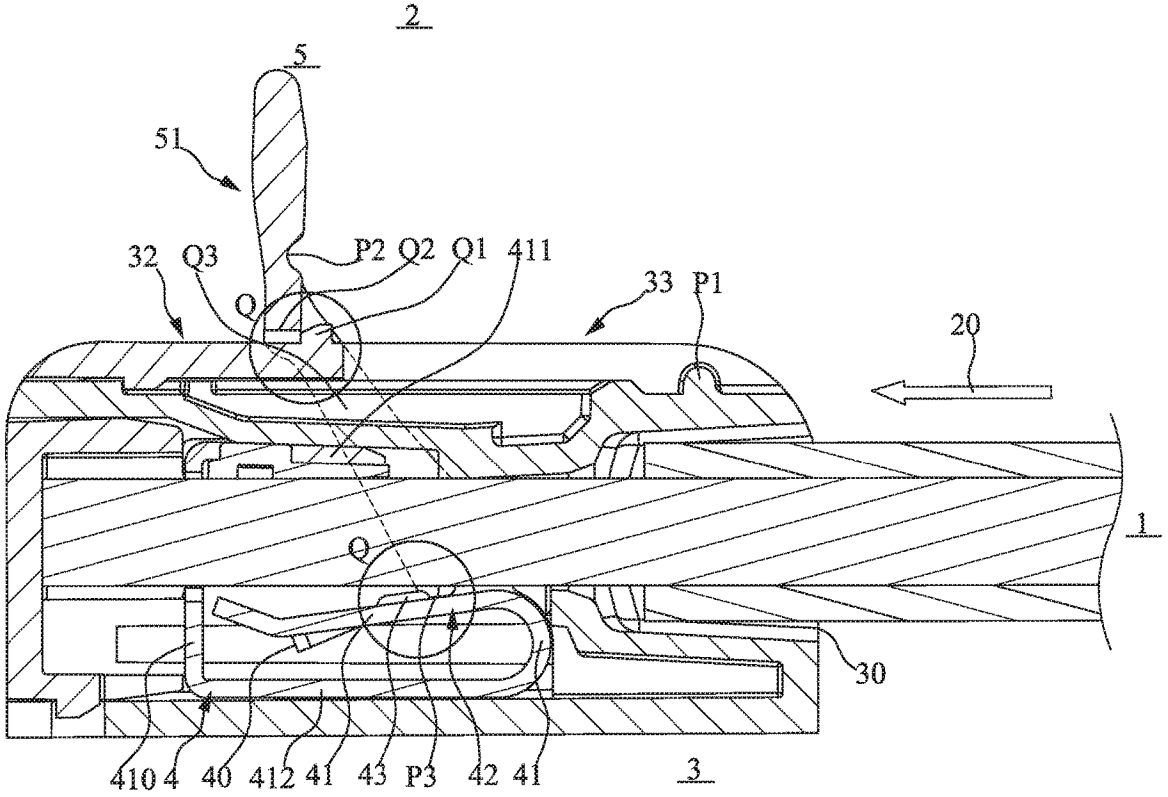
FIG. 5 is a cross-sectional view shows the wire is inserted in the wire connector according to a preferred embodiment of the present invention.

Please refer to FIGS. 1A, 4 and 5, a plurality of wires 1 are electronically connected to each other for inserting into a wire connector 2 of the present invention. More particularly refer to FIGS. 1A, 1B and. 2, the wire connector 2 comprises three parts of a cover 3, a conductor 4 and a plurality of shift levers 5.

Figure 1B:
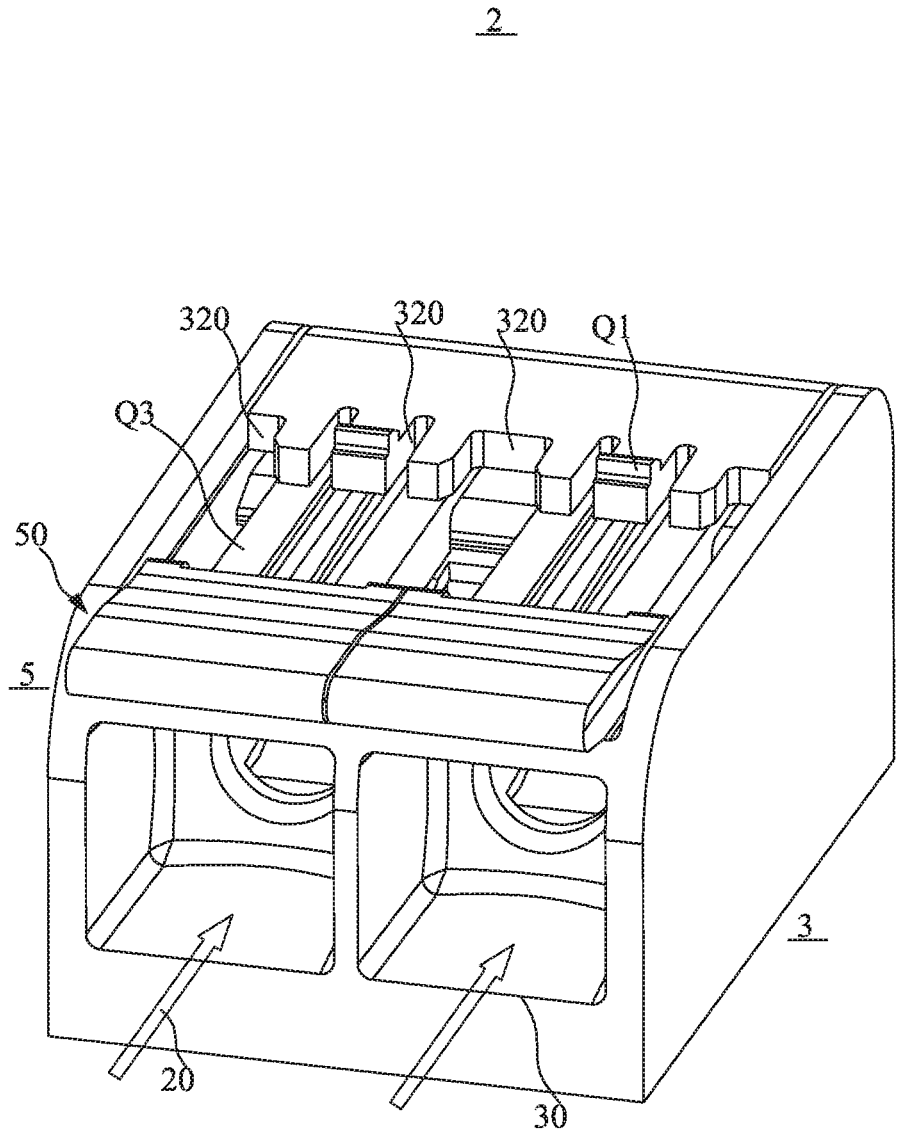
FIG. 1B is another perspective view of the wire connector.
Figure 2:
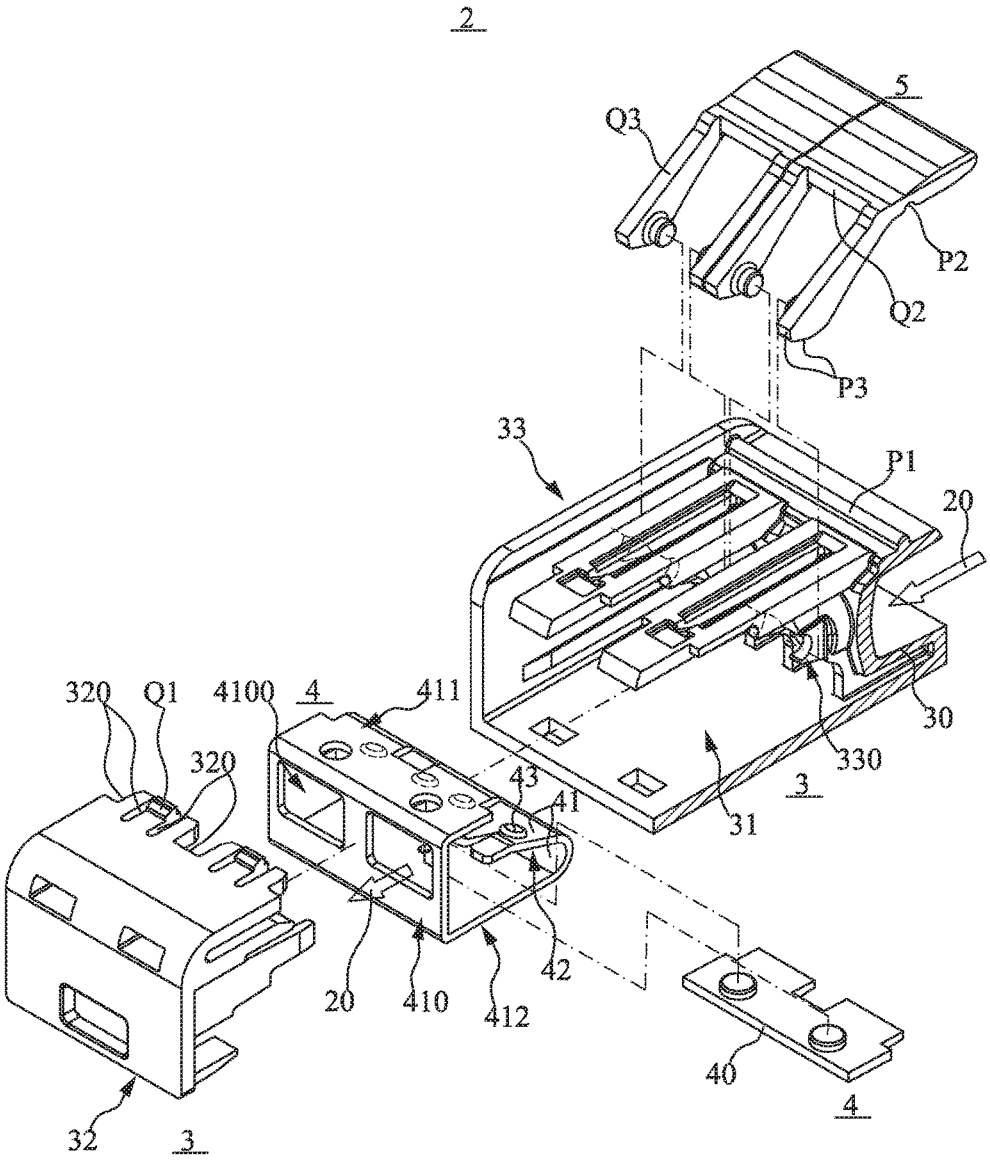
FIG. 2 is an exploded perspective view of the wire connector shown in FIG. 1A.

Please refer to FIGS. 1A, 1B and 2, the wire connector 2 is provided an inserting direction 20 for the end of the wires 1 to insert therein, the cover 3 has a plurality of inserting holes 30 which communicate to the external correspond with the inserting direction 20. The end of the wire 1 can be inserted into a receiving space 31 of the cover 3.

The cover 3 is composed of a first cover member 32 and a second cover member 33. Both of the first cover member 32 and the second cover member 33 are assembled with each other along the inserting direction 20. A surface of the first cover member 32 has a plurality of second blocks Q1 for corresponding the extension position and quantity of the inserting holes 30. A plurality of slots 320 are formed around the second blocks Q1 along the inserting direction 20. Furthermore, a surface of the second cover member 33 has a first block P1, and the interior of the second cover member 33 forms a plurality of pivoted holes 330 perpendicular to the inserting direction 20. The shift lever 5 is pivoted on the pivoted holes 330.

The conductor 4 is assembled in the receiving space 31 which is inside of the cover 3, and composed of a conductive portion 40, a connect portion 41 and a plurality of the elastic portions 42 which are connected with the connect portion 41. In a preferred embodiment, the conductive portion 40 is designed in a form as a conductive plate. The connect portion 41 comprises a penetrative portion 410, an upper connect portion 411 and a lower connect portion 412. The penetrative portion 410 is formed on an extension path of the inserting direction 20, and substantially vertical to the inserting direction 20. The penetrative portion 410 has a plurality of penetrative holes 4100 which are corresponding to the position and quantity of the inserting holes 30.

Moreover, the upper connect portion 411 and the lower connect portion 412 are formed at two opposite sides of the penetrative portion 410 respectively. Both of the upper connect portion 411 and the lower connect portion 412 are substantially parallel to the inserting direction 20. In a preferred embodiment, the upper connect portion 411 can be assembled to the conductive portion 40 by a fasten way. The elastic portions 42 are bended (U type or V type) by a metal material, and the lower connect portion 412 further comprises a third block 42 on a surface adjacent to the wire 1.

Before the end of the wire 1 inserts the receiving space 31, the lower connect portion 412 is pressed by the shift lever 5 for changing the angel between the lower connect portion 412 and the lower connect portion 412. The opposite surfaces of the wire 1 are clamped and fixed by the upper connect portion 411 and the lower connect portion 412, so that the wire 1 can penetrate into the penetrative hole 4100.

Please refer to FIGS. 1A to 3A, the shift lever 5 comprises an operation portion for user hand to touch. The operation portion forms a first groove P2 adjacent to the surface of the cover 3. The first groove P2 is designed to be correspondent with the position of the first block P1, and the first groove P2 of the shift lever 5 can be fixed by the first block P1 of the cover 3. In an unused state of the wire connector 2, the shift lever 5 can be fixed on the surface of the cover 3 in the first position 50, so that the first block P1 and the first groove P2 are construed of a first fixed device P in the first position 50 collectively. Thereby provide a sense of user hand for ensuring whether the shift lever 5 has fixed in the surface of the cover 3. The user does not need to keep pressure the shift lever 5 for avoiding uncertainty of fixing the shift lever 5.

Please refer to FIGS. 1A to 3B, one side of the operation portion extends two shift bars Q3 from the opposite end of the operation portion. A second groove Q2 is formed between the operation portion of the shift lever 5 and the shift bars Q3. The shift bars Q3 have a pressure portion P3 which are formed on a surface of the end and a pivoted axle which is formed on an adjacent surface between the shift bars Q3. The pivoted axles of the shift lever 5 are pivoted with the pivoted holes 330 of the cover 3, so that the shift lever 5 can swing back and forth relative to the cover 3.

In a preferred embodiment, the width of the shift bar Q3 gradually expands to form a trapezoid shape from the end of the operation portion. The width of the pressure portion P3 is formed a smallest width of the shift bar Q3. A part of the shift bar Q3 is formed an arc shape with a biggest width near the pressure portion P3.

Please refer to FIGS. 1A to 3C show the swing process of the shift lever 5. The shift lever 5 move to a second position 51 that the elastic portion 42 would contact the biggest width of the shift bar Q3 from the first position 50 that the elastic portion 42 of the conductor 4 would not contact the shift lever 5. Since the shift bar Q3 is designed an arc shape near the pressure portion P3, the shift bar Q3 could provide a sense for user hand to know the present state of the shift lever 5 by one of non-contacting, contacting or pressuring state of the conductor 4.

Figure 3A:
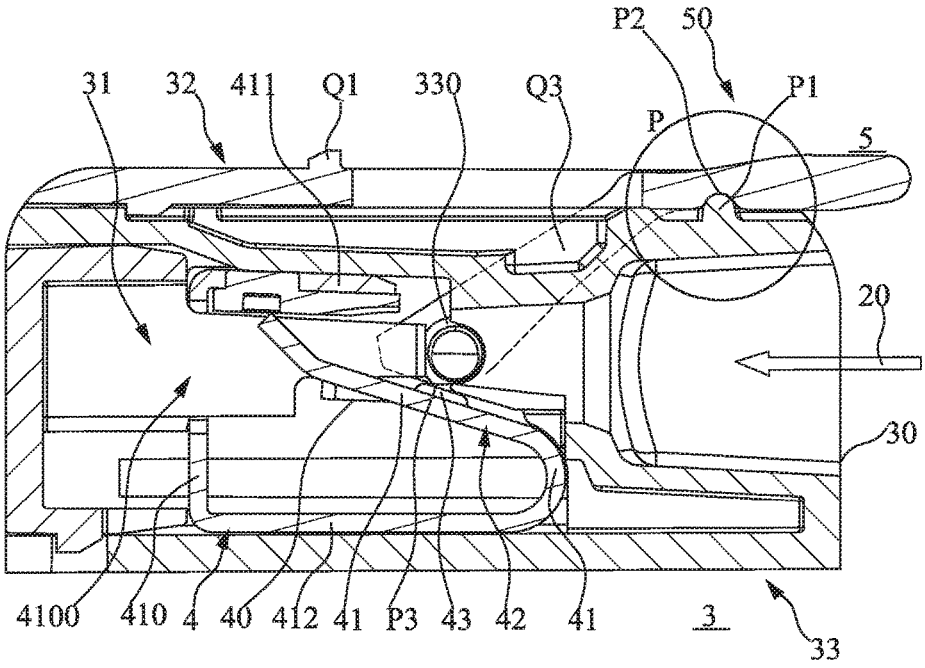
FIG. 3A is a cross-sectional view of the wire connector shown in FIG. 1A.
Figure 3B:
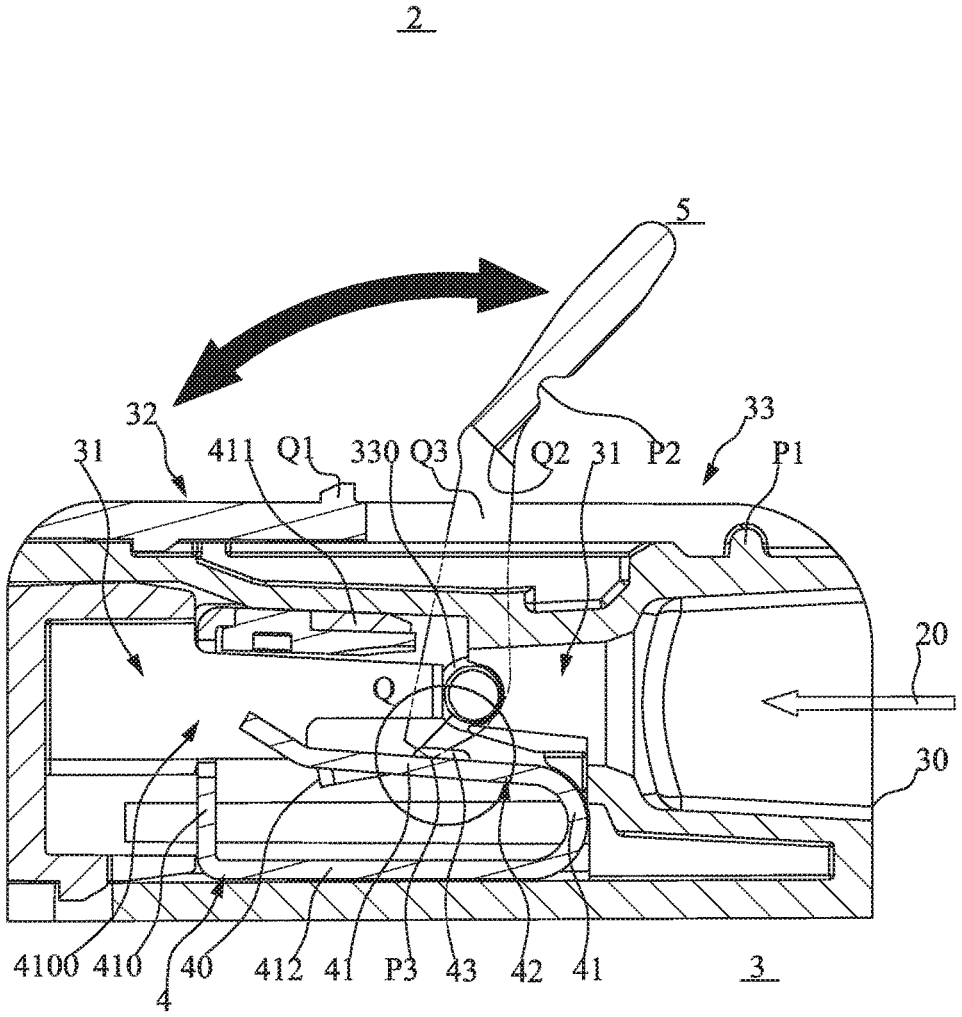
FIG. 3B is another sectional view shows the movement of the shift lever.
Figure 3C:
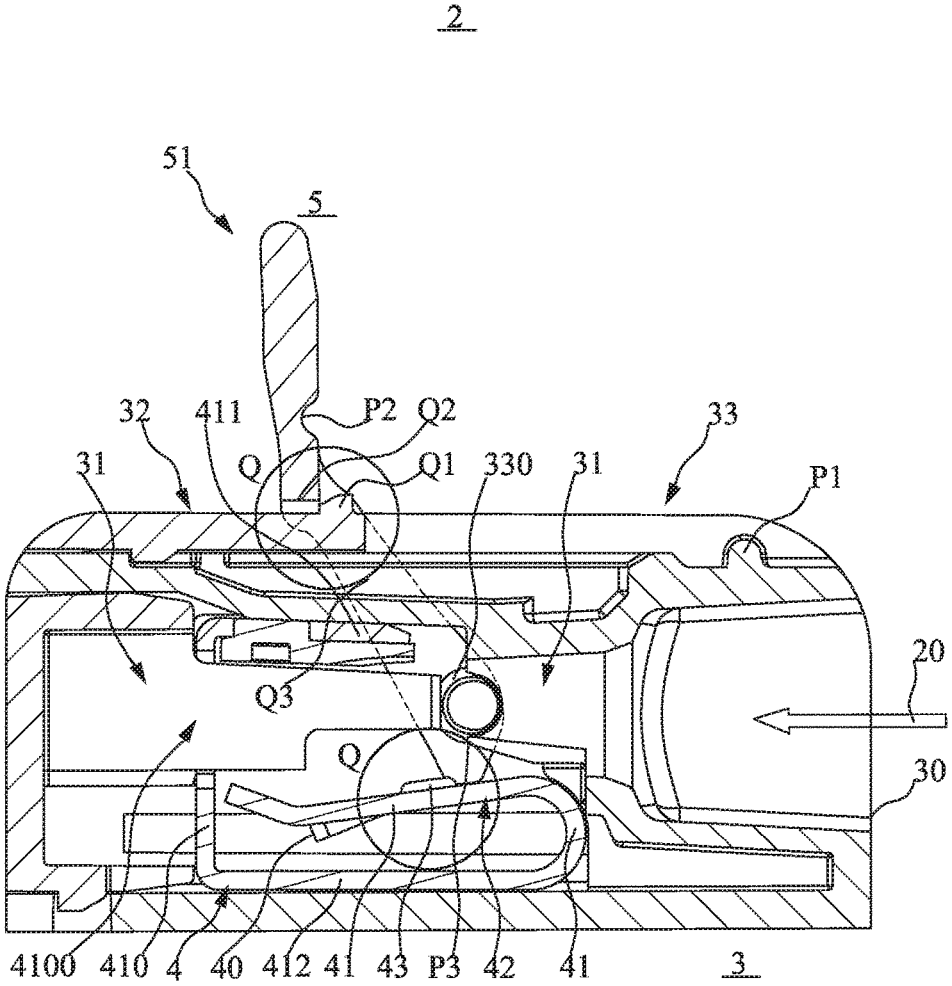
FIG. 3C is another sectional view shows the shift lever is fixed on the cover.

While the shift bar Q3 of the shift lever 5 being pushed into the slot 320 of the first cover member 32 by user hand, the shift bar Q3 keep swinging into the slot 320 until the second groove Q2 of the shift lever 5 is fixed with the second block Q1 of the first cover member 32 (refer to FIG. 3C). Thereby, the user could know whether the shift lever 5 is fixed on the first cover member 32 without wasting other unnecessary force to pressure. As a result, the second groove Q2 of the shift lever 5 and the second block Q1 of the first cover member 32 are constructed of the second fixed device Q in the second position 51, so that the shift lever 5 of present invention can be fixed on the surface of the cover 3 in the second position 51.

Please refer to FIG. 3C, further to clamp the wire 1 firmly during the wire 1 is inserted into the wire connector 2. The second fixed device Q further comprises a third block 42 which is formed on the lower connect portion 412 of the connect portion 41 for corresponding to contact the pressure portion P3 of the shift lever 5. So that the pressure portion P3 and the third block 41 are collectively formed a second fixed way in the second position 51 for preventing the shift lever 5 from generating a movement when the wire connector 2 is crashed by an external force. Therefore, the present of invention can reduce the possibility of the wire 1 moving away from the wire connector 2 and provide an operation sense for user to know whether the shift lever 5 is fixed firmly.

Please refer FIGS. 4 and 5 to show the position of the wire 1 relative to the other member inside the wire connector 2, while the wire 1 has been inserted into the wire connector 2. According to above description, the first fixed device P and the second fixed device Q are designed between the cover 3, the conductor 4 and the shift lever 5 of the wire connector 2. So that the shift lever 5 can be fixed in the first position 50 and the second position 51 whether the wire 1 is inserted into the wire connector 2 or not. The present invention designs two different kinds of fixed devices in the moving track of the shift lever for simplifying the fixing steps of inserting the wire and increasing the convenience of manual operation. In addition, the present invention reduces the connection steps of the wires and the equipment cost corresponding to the connection steps, meanwhile, increases the convenience for connecting, distributing or repairing the wires.

What is claimed is:

1. A wire connector for a plurality of wires being inserted along an inserting direction, comprising:

a cover, having a plurality of inserting holes along the inserting direction and a receiving space in communication with the plurality of inserting holes;

a conductor in the receiving space of the cover and comprising a conductive portion that contacts the wires and a plurality of elastic portions that are located in an extended position of each inserting hole, respectively, so that the wire is clamped by the conductive portion and the elastic portion after being inserted into an interior of the cover; and a plurality of shift levers, being pivoted on the cover, and swinging between a first position in which the shift levers do not contact the elastic portion and a second position in which the plurality of shift levers press the elastic portion, causing a deformation of the elastic portion;

wherein the wire connector further comprises:

a first fastening device for fastening the shift levers in the first position; and a second fastening device for fastening the shift levers in the second position.

2. The wire connector as claimed in claim 1, wherein the first fastening device comprises a first block being formed with one of the shift levers and the cover, and a first groove being formed with another of the shift levers and the cover for corresponding the position of the first block.

3. The wire connector claimed as claim 1, wherein the second fastening device is formed with the group consisting of both of the shift levers and the cover, both of the shift levers and the elastic portions, and triple of the shifts, the cover and the elastic portions.

4. The wire connector claimed as claim 3, wherein the second fastening device comprises a plurality of shift bars extending from the opposite sides of the shift levers and a plurality of slots are dividedly formed on the cover for corresponding the position of the shift bars.

5. The wire connector claimed as claim 3, wherein the second fastening device comprises a second block being formed with one of the shift levers and the cover and a second groove being formed with another of the shift levers and the cover for corresponding with the position of the second block.

6. The wire connector claimed as claim 5, wherein the second fastening device comprises a third block being formed with the elastic portion and a pressure portion being formed the shift lever for corresponding with the position of the third block.

7. The wire connector claimed as claim 5, wherein the second fastening device comprises a plurality of shift bars are extending from the opposite sides of the shift levers and a plurality of slots are dividedly formed on the cover for corresponding the position of the shift bars.

8. The wire connector claimed as claim 7, wherein the second fastening device comprises a third block being formed with the elastic portion and a pressure portion being formed with the shift lever for corresponding the position of the third block.

* * * * *